United States Patent [19]

Lindberg

[11] 4,105,726

[45] Aug. 8, 1978

[54] SOLENOID APPARATUS

[75] Inventor: Allen W. Lindberg, Kirkwood, Mo.

[73] Assignee: ACF Industries, Inc., New York, N.Y.

[21] Appl. No.: 767,874

[22] Filed: Feb. 11, 1977

[51] Int. Cl.[2] ..... F02M 7/24

[52] U.S. Cl. ..... 261/121 B; 123/119 EC; 251/137

[58] Field of Search ..... 261/121 B; 123/119 EC; 251/137

[56] References Cited

U.S. PATENT DOCUMENTS

| | | | |
|---|---|---|---|
| 2,407,184 | 9/1946 | Sparrow | 251/137 |
| 2,579,723 | 12/1951 | Best | 251/137 |
| 3,534,720 | 10/1970 | DuBois | 251/137 |
| 3,814,376 | 6/1974 | Reinicke | 251/137 |
| 3,858,135 | 12/1974 | Gray | 251/137 |
| 3,906,910 | 9/1975 | Szlaga, Jr. | 261/121 B |
| 3,921,612 | 11/1975 | Aono | 261/121 B |
| 3,942,493 | 3/1976 | Linder et al. | 261/121 B |
| 3,987,131 | 10/1976 | Hisatomi et al. | 261/121 B |
| 4,023,357 | 5/1977 | Masaki | 261/121 B |
| 4,030,462 | 6/1977 | Sasayama et al. | 123/119 EC |

*Primary Examiner*—Tim R. Miles

[57] ABSTRACT

Solenoid apparatus. First and second electrical windings are supplied current and the current flow through each of the windings induces respective magnetic fields the strengths of which are functions of the average current flow therethrough and the magnetic fields combine to produce a net magnetic field. An armature is movable in either of two directions between a first position and a second position through a predetermined number of discrete intermediate positions. The armature is biased toward one of the intermediate positions constituting a reference position and the position of the armature at any one time is determined by the strength of the net magnetic field and a biasing force on the armature. A current source supplies current to the windings and the current source is controllable to vary the average current flow in each winding to produce movement of the armature from one position to another. The average current flow in each winding is variable between a minimum and a maximum value in steps and the predetermined number of intermediate positions to which the armature is movable corresponds to the number of these steps.

2 Claims, 5 Drawing Figures

FF1
FF2
D
S
CL
R
Q
51
53
55
57
33
39
37
47
109
107
111
155
169
171
173
165
167
+V
G1
G2
G3
G7
D1
D2
D9
Q1
Q2
R1
R2
R3
R4
R5
R6
R7
R8
R9
R10
R11
R12
R13
R14
R15
R16
R17
R46
R47
R48
R49
R56
R57
R58
R59
R60
R60A
R61
R62
R63
R64
R65
R66
R67
R68
R69
C1
C2
C3
C4
C5
C6
C7
C8
C9
C14
C15
C16
C17
C18
C19
C20
C21
C22

SOLENOID APPARATUS

BACKGROUND OF THE INVENTION

This invention relates to solenoid apparatus and more particularly to such apparatus for use with means for controlling the ratio of air to fuel in a mixture to be combusted in an internal combustion engine.

The control of emissions from internal combustion engines and particularly automobile engines has become a major environmental concern. Various federal and state regulatory agencies have promulgated emission standards for certain substances found in the combustion products entering the atmosphere through an engine's exhaust, the most important of these substances being hydrocarbons, carbon monoxide and oxides of nitrogen. To meet emission control standards, various pollution control devices such as catalytic converters and thermal reactors have been developed for use with automobile engines to reduce the quantities of unwanted substances emitted into the atmosphere to within prescribed limits.

It has been found that most efficient removal of unwanted substances by pollution control devices is achieved when an engine is operated within a narrow range of air-fuel ratio values for an air-fuel mixture combusted in an engine. Consequently, numerous systems have been developed which attempt to maintain the air-fuel ratio of a mixture to be combusted in an engine within this value range. Examples of systems of this type are disclosed in U.S. Pat. Nos. 3,939,654, 3,946,198, 3,949,551 and 3,963,009. While the systems disclosed in these patents do tend to keep the air-fuel ratio for a mixture to be combusted within the value range where maximum efficiency in removal is obtained, this is usually accomplished only by constantly adjusting the air-fuel ratio. Further, overadjustments frequently occur which then require additional corrections and the systems respond to transitory changes in an engine's operating characteristic to make adjustments when none are actually needed.

SUMMARY OF THE INVENTION

Among the several objects of the present invention may be noted the provision of solenoid apparatus useful with means for controlling the air-fuel ratio of a mixture to be combusted in an internal combustion engine and adapted for other uses; the provision of such apparatus which meters the quantity of air supplied to a fuel system in a carburetor for the internal combustion engine; the provision of such apparatus which simultaneously meters the quantity of air supplied to a second fuel system in the carburetor; the provision of such apparatus which reliably and accurately meters the quantity of air flowing to both fuel systems; and the provision of such apparatus which is economical to manufacture and easy to install and operate.

Briefly, solenoid apparatus of the present invention comprises first and second electrical windings to which current is supplied, current flow through each of the windings inducing respective magnetic fields the strengths of which are functions of the average current flow therethrough and the magnetic fields combining to produce a net magnetic field. An armature is movable in either of two directions between a first position and a second position through a predetermined number of discrete intermediate positions and means is provided for biasing the armature toward one of the intermedite positions which constitutes a reference position. The position of the armature at any one time is determined by the strength of the net magnetic field and a force on the armature produced by the biasing means. Current supply means supplies current to the windings and control means is provided to which the current supply means is responsive for varying the average current flow in each winding to produce movement of the armature from one position to another. The average current flow in each winding is variable between a minimum and a maximum value in steps and the predetermined number of intermediate positions to which the armature is movable corresponds to the number of these steps. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
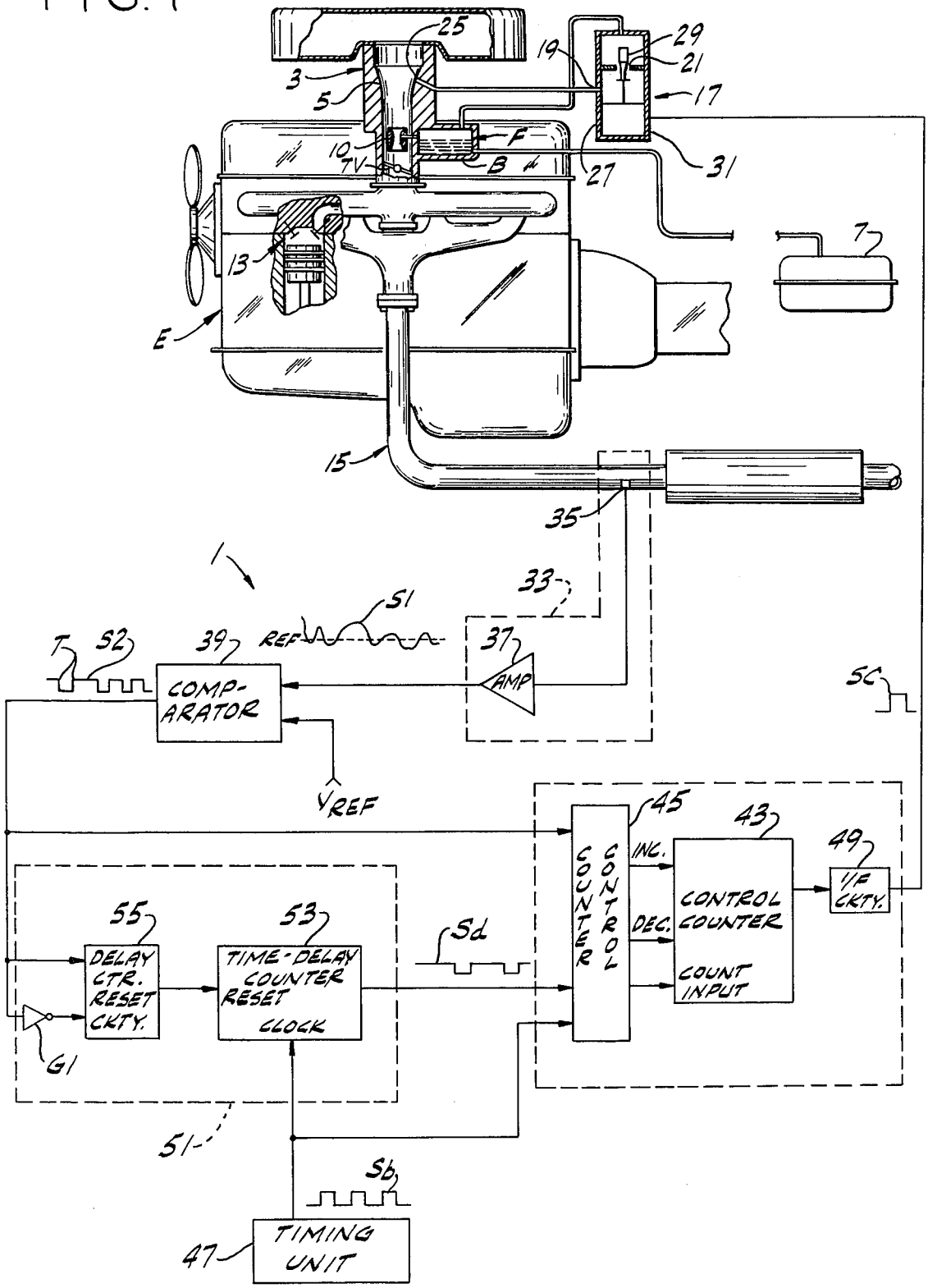
FIG. 1 is a block diagram of means for controlling the air-fuel ratio in an internal combustion engine which includes solenoid apparatus of the present invention.

Referring now to the drawings, apparatus for controlling the air-fuel ratio in an internal-combustion engine E to substantially maintain the ratio at a predetermined value while the engine is operating under various load conditions is indicated generally at 1. Engine E has a carburetor 3 with an air passageway 5 through which air is drawn into the engine and fuel F from a source 7 is supplied to the carburetor through at least one fuel system 9 and mixed with air passing through the carburetor. The carburetor also has a throttle valve TV to control the flow rate of air through the carburetor and a venturi 10 by which a pressure differential is created so that fuel F is drawn through fuel system 9 and mixed with air to produce an air-fuel mixture, all as is well known in the art. Carburetor 3 further has a conduit 11 through which air is introduced into fuel system 9 as will be discussed. Engine E further has a chamber 13 for combustion of the resulting air-fuel mixture and an exhaust system 15 for exhausting the products of combustion.

An air metering unit generally indicated 17 meters the quantity of air introduced into fuel system 9 through conduit 11 to control the air-fuel ratio of the mixture. The unit has an air inlet 19 and an air outlet 21 which communicates with conduit 11. A portion of the air entering carburetor 3 through passageway 5 enters a conduit 23 via an opening 25 in the side of the passageway and enters air metering unit 17 through inlet 19. This air enters a chamber 27 in the metering unit and exits the chamber through outlet 21. Disposed in outlet 21 is a metering pin 29, which is a tapered metering pin and which is insertable into and withdrawable from the outlet to control the quantity of air admitted into conduit 11. The position of metering pin 29 in outlet 21 is controlled by a positioner 31. Withdrawal of metering pin 29 from outlet 21 by the positioner admits more air into conduit 11 while insertion of the metering pin into the outlet admits less air into the conduit. With more air flowing through conduit 11 and entering fuel system 9 there is a decrease in the flow rate of fuel through the system so that less fuel is mixed with air and the air-fuel ratio of the resulting mixture increases (i.e., the mixture becomes leaner). When less air enters fuel system 9 through conduit 11 the flow rate of fuel increases, more fuel is mixed with the air and the air-fuel ratio decreases (i.e., the mixture becomes richer). It will be understood that air metering unit 17 may be formed as part of carburetor 3 or may be a separate unit installed at a convenient location with respect to engine E and the carburetor.

Among the products of combustion exhausted through system 21 is free oxygen and the amount of this oxygen is a function of the air-fuel ratio of the mixture combusted in chamber 13, i.e., the richer the mixture the less free oxygen is in the combustion products and the leaner the mixture the more free oxygen is present. The presence of oxygen in the products of combustion is sensed by an oxygen sensor 33 from which is supplied a first electrical signal S1 representative of the oxygen content. The dashed line REF shown in FIG. 1 represents the oxygen content in the products of combustion at the predetermined air-fuel ratio value. Sensor 33 includes a detector 35 positioned in the exhaust system and responsive to the oxygen content to generate a voltage whose amplitude is a function of the oxygen content and inversely related thereto, i.e., the more oxygen present in the exhaust system (the leaner the mixture) the lower is the amplitude of the generated voltage and vice versa. The detector may be a zirconia type detector or any other suitable oxygen detector. The voltage generated by detector 35 is amplified by an amplifier 37 to produce first electrical signal S1 which is an analog signal.

A comparator 39, which is a voltage comparator, compares first electrical signal S1 (the amplitude of the signal) with a predetermined reference level V ref. (a voltage level) which is a function of the predetermined air-fuel ratio value at which engine E is to operate to produce a second electrical signal S2 having first and second signal elements. A first signal element of the second electrical signal (a logic high) is produced when the air-fuel ratio of the mixture is greater than the predetermined level (the amplitude of signal S1 is less than the reference voltage level) and a second signal element (a logic low) is produced when the ratio is less than the value (the amplitude of signal S1 is greater than the reference voltage level). A transition T from one signal element to the other occurs whenever the amplitude of signal S1 changes from greater to less than the reference voltage amplitude and vice versa.

A controller 41 is responsive to second electrical signal S2 to supply to air metering unit 17, and specifically positioner 31 of the air metering unit, a control signal S*c* by which the quantity of air introduced into conduit 11 is controlled. The controller includes a reversible accumulating control counter 43 and a counter control 45. The counter control is responsive to first and second signal elements of the second electrical signal to increment and decrement the contents of the control counter. The contents of the control counter are incremented when less air is to be introduced into conduit 11 and the air-fuel mixture made richer and decremented when more air is to be introduced into the conduit and the mixture made leaner. A timing unit 47 generates a timing signal S*t* having a plurality of signal elements which are supplied to a count input of control counter 43, through counter control 45, to increment and decrement its contents. The contents of the control counter are incremented by elements of the timing signal when a first signal element of the second electrical signal is supplied to counter control 45 and decremented by timing signal elements when a second signal element of the second electrical signal is supplied to the counter control. Controller 41 further includes an interface circuit 49 to which control counter 43 supplies a digital signal representative of the value of its contents. Interface 49 is responsive to the digital signal to produce the control signal supplied to air metering unit 17. Controller 41 is responsive to the second electrical signal to produce a change in the control signal whenever the second electrical signal has a transition T from one signal element to the other, i.e., the contents of control counter 43 are incremented instead of decremented of vice versa. This results in a change in the digital signal supplied to interface 49 and in the control signal produced by the interface portion of the controller. A change in the control signal supplied to air metering unit 17 results in the air metering unit changing the quantity of air introduced into conduit 11 by an amount necessary to substantially maintain the air-fuel ratio at the predetermined value. Thus, a change in the control signal from controller 41 to positioner 31 of metering unit 17 produces a change in the position of metering pin 29 in outlet 21 and modulates the quantity of air introduced into fuel system 9. The air-fuel ratio of the mixture combusted in chamber 13 is thus varied and is driven toward the desired value.

Besides being supplied to controller 41, the second electrical signal is sampled by a sampler 51. This sampling occurs over a predetermined time interval starting when a signal element of the second electrical signal is produced and its purpose is to determine whether a transition between signal elements occurs within the time interval. Elements of timing signal S*t* are supplied to sampler 51 which includes a time-delay counter 53 responsive to the timing signal elements for counting from zero to a preselected value which may, for example, be two and for inhibiting counter control 45 from incrementing or decrementing the contents of control counter 43 until the preselected value is reached. Delay counter 53 supplies first and second signal elements of a delay signal S*d* to counter control 45. A first signal element of the delay signal is supplied to counter control 45 whenever the value of the contents of delay counter 53 is less than the preselected value and a second signal element of the delay signal is supplied to the counter control when the preselected count value is reached. When a first signal element is supplied to counter control 45, the counter control is inhibited for passing timing signal elements to control counter 43, as will be discussed, and the contents of the counter are unchanged. Only when a second signal element of the delay signal is supplied to counter control 45 is the contents of counter 43 incremented or decremented. Further, sampler 51 includes a delay counter reset circuit 55 responsive to each transition between signal elements of the second electrical signal to reset the value of the delay counter contents to zero. Consequently, if a transition between signal elements of the second electrical signal occurs within the predetermined time interval, i.e., before the count value of counter 53 reaches two, counter control 45 remains inhibited because it is still supplied with a first signal element of the delay signal and no change is produced in the contents of control counter 43 or in the control signal supplied to air metering unit 17. Thus, controller 41 is responsive to sampler 51 to produce a change in the control signal only if no transition between signal elements occurs within the predetermined time interval. If a transition does occur within the interval, no change in the control signal is produced and the quantity of air introduced into conduit 11 remains the same.

The importance of this sampling feature is that it prevents continuous adjustment of the air-fuel ratio of the combusted mixture. Thus, for example, momentary or transient changes which occur do not result in an adjustment, when none is actually needed, and eliminates the need for a second adjustment which would otherwise result when the transient change is over. By providing for a "second look" at the air-fuel ratio relative to the predetermined value before making an adjustment, the apparatus responds only to long term changes and makes an adjustment to the air-fuel ratio only when one is actually needed to return the ratio value to the point where the most efficient removal of substances from the exhaust products is accomplished as, for example, by a catalytic converter 56 in the engine's exhaust system.

Figure 3:
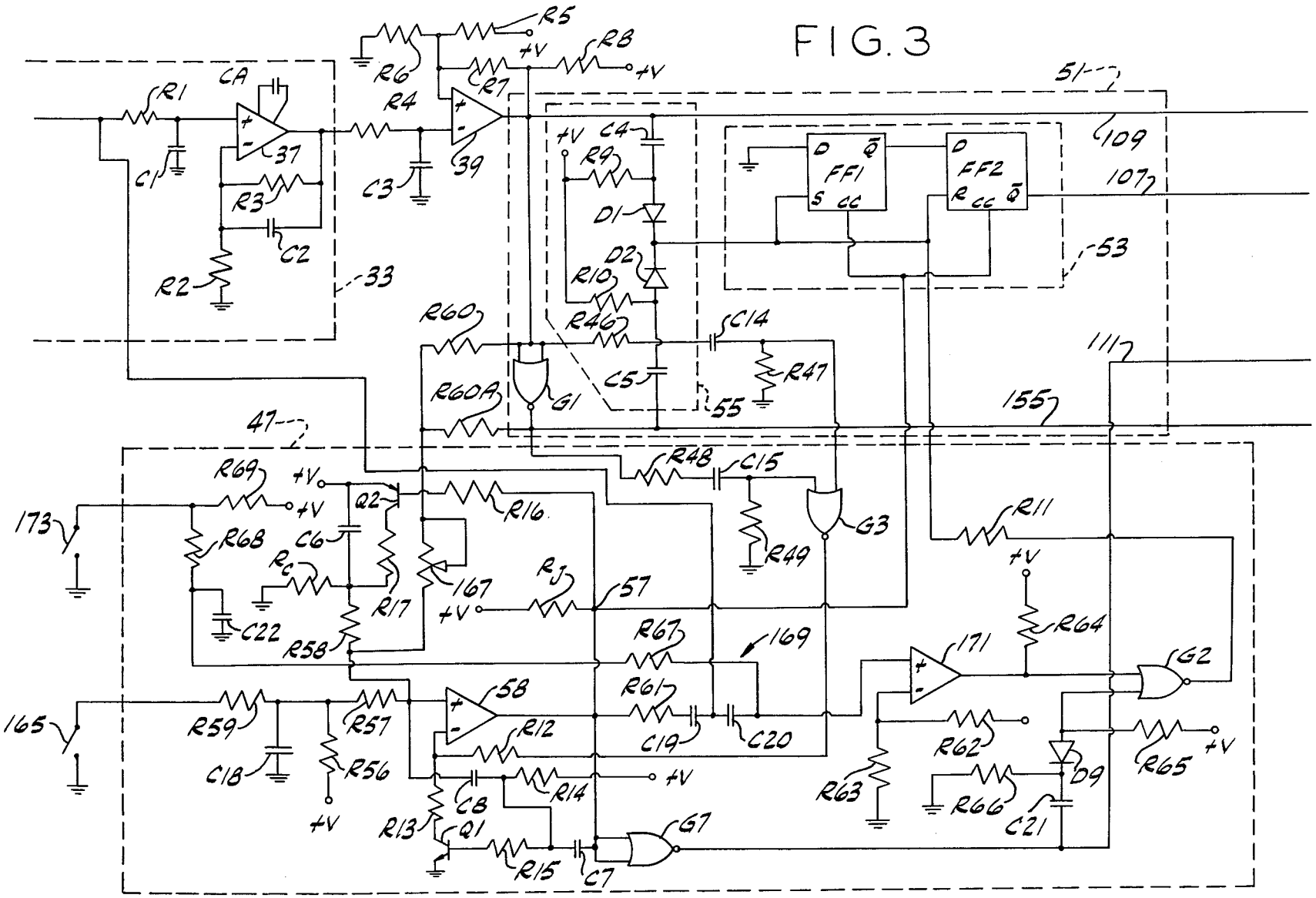
FIG. 3 is a schematic circuit diagram of a portion of the circuitry employed with solenoid apparatus of the present invention.

Referring to FIG. 3, the voltage developed by detector 35 is supplied through a filter network comprised of a resistor R1 and a capacitor C1 and applied to one input (the non-inverting input) of amplifier 37 which is an operational amplifier and includes a capacitor CA. Preferably, the amplifier has a field-effect transistor (FET) input circuit which imposes a substantially zero current load on the detector. The amplifier gain is determined by a pair of resistors R2 and R3 and a feedback capacitor C2 and is, for example, five. From the output of amplifier 37 is supplied first electrical signal S1 which is applied to one input of comparator 39, the inverting input of an operational amplifier, through a filter network comprised of a resistor R4 and a capacitor C3. The comparator has a second input to which is applied the reference level V ref. This level is a voltage developed across a divider network comprised of a pair of resistors R5 and R6 and may, for example, represent the air-fuel ratio of the mixture at the stoichiometric point. The comparator circuitry further includes a feedback resistor R7 and a pull-up resistor R8. First and second signal elements of the second electrical signal are supplied from the output of comparator 39. Because the first electrical signal is supplied to the inverting input of the comparator, a first signal element of the second electrical signal, a logic high, is produced when the amplitude of the first electrical signal is less than the reference voltage amplitude and a second signal element, a logic low, is produced when the amplitude of the first electrical signal exceeds the reference voltage amplitude.

Sampler 51, as noted, includes delay counter 53 and counter reset circuitry 55. Counter 53 is a two-stage binary counter comprised of a pair of flip-flops FF1 and FF2 respectively. The data input to flip-flop FF1 is grounded, while the data input of flip-flop FF2 is connected to the $\overline{Q}$ output of flip-flop FF1. Elements of delay signal Sd are supplied to counter control 45 from the $\overline{Q}$ output of flip-flop FF2. Counter reset circuitry 55 includes a pair of diodes D1 and D2 and a pair of R-C networks respectively comprised of a resistor R9 and a capacitor C4 and a resistor R10 and a capacitor C5. One side of capacitor C4 is connected to the output of comparator 39, while one side of capacitor C5 is connected to the output of a NOR gate G1 which serves to invert the second electrical signal supplied by comparator 39. The cathodes of diodes D1 and D2 are commonly connected and are tied to the set input of flip-flop FF1 and the reset input of flip-flop FF2. Further, the cathodes are connected through a resistor R11 to the output of a NOR gate G2, the function of which will be discussed. The resistance values of resistors R9 and R10 are each approximately 100 times larger than that of resistor R11.

With the logic output of gate G2 low, each transition between signal elements of the second electrical signal results in a positive pulse being applied to the set input of flip-flop FF1 and the reset input of flip-flop FF2. An element of timing signal S*t* supplied to the clock input of each flip-flop at this time results in the $\overline{Q}$ output of flip-flop FF1 going low and the $\overline{Q}$ output of flip-flop FF2 going high. This is the reset state of counter 53. When the next element of the timing signal is supplied to the clock inputs of the flip-flops, the $\overline{Q}$ output of flip-flop FF1 goes from low to high because the data input to the flip-flop is low. The $\overline{Q}$ output of flip-flop FF2 however remains high. When the next or second signal element of the timing signal is supplied to the clock inputs of the flip-flops, the $\overline{Q}$ output of flip-flop FF2 goes low because the data input to the flip-flop is now high. The $\overline{Q}$ output of flip-flop FF1 however remains high. Subsequent signal elements of the timing signal supplied to the clock input of the flip-flops do not effect a change in the $\overline{Q}$ output of either flip-flop unless the flip-flops are reset, in which instance the preceding sequence of events is repeated. A first signal element of the delay signal corresponds to the logic high at the $\overline{Q}$ output of flip-flop FF2 prior to a second timing signal element being supplied to the clock input of the flip-flops after delay counter 53 is reset. A second signal element of the delay signal corresponds to the logic low present at the $\overline{Q}$ output of flip-flop FF2 from the time the second timing signal element is supplied to the flip-flops, after the counter is reset, until the counter is again reset.

Elements of the timing signal generated by timing unit 47 and supplied to sampler 51 are developed at a junction point 57 within the timing unit. The timing unit includes a timing capacitor C6 and if this capacitor is assumed to be discharged, a voltage corresponding to a logic high is present at the junction and is supplied through a resistor R*j*. Capacitor C6 is negatively charged through a resistor R*c* and the charge level of the capacitor is applied to one input of a comparator 58 which is the non-inverting input of an operational amplifier. A reference voltage corresponding to a predetermined charge level of capacitor C6 is applied to a second input of the comparator (the inverting input of the amplifier), this voltage being developed across a divider network comprised of a pair of resistors R12 and R13 respectively when an NPN transistor Q1 is conducting and the logic output of a NOR gate G3 is high. Base voltage for transistor Q1 is supplied through a pair of resistors R14 and R15 respectively and with capacitor C6 discharged, the transistor conducts. Connected between capacitor C6 and electrical ground is a PNP transistor Q2 which is biased off when a logic high is present at junction 57. The output of comparator 58 is connected to the base of transistor Q2 through a resistor R16.

With capacitor C6 discharged, a logic high is supplied from the output of comparator 58 because the voltage level at the non-inverting input to the comparator, which corresponds to the capacitor charge level, exceeds the reference voltage. As capacitor C6 charges, this voltage level decreases and eventually falls below the reference level. When this occurs, the logic output of comparator 58 goes low driving junction 57 low. Transistor Q1 turns off because of coupling through a capacitor C7 to the low comparator output while transistor Q2 is biased into conduction. With transistor Q2 on, capacitor C6 discharges through a resistor R17. Positive feedback to the non-inverting input of comparator 58 through a capacitor C8 and capacitor C7, forces a complete high to low transition in the comparator output signal. This logic low is maintained while capacitor C7 charges and transistor Q1 is switched back into conduction. Capacitor C6 fully discharges during this period and when transistor Q1 again conducts the reference level is again applied to the inverting input of comparator 58 causing a transition at the comparator output from a logic low to high. This takes transistor Q2 out of conduction and capacitor C6 starts charging again. At junction 57, a negative going pulse or signal element of the timing signal has been produced and supplied to the clock inputs of flip-flops FF1 and FF2.

Figures 2, 5:
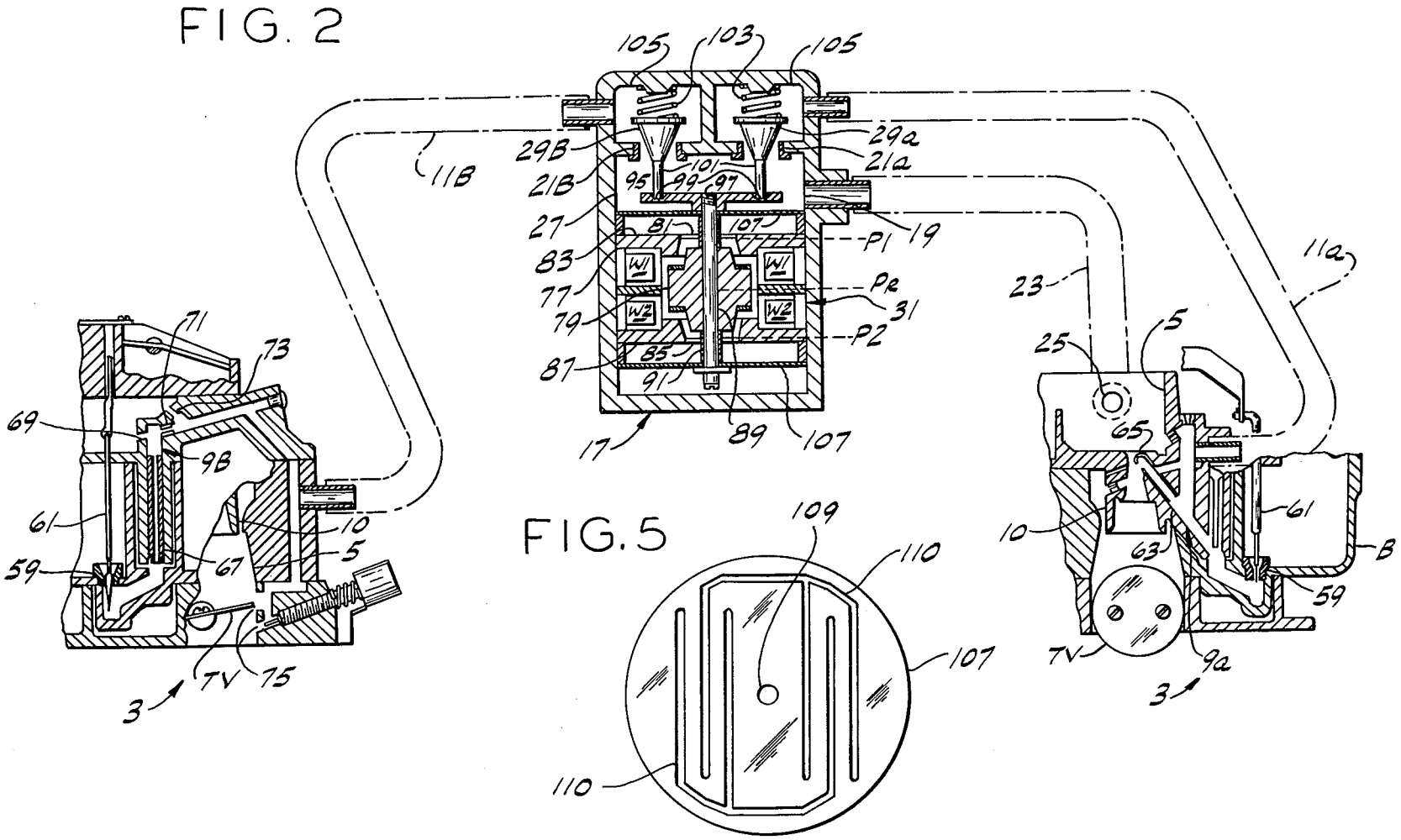
FIG. 2 is a view illustrating in section the low and high speed circuits of a carburetor and an air metering unit which includes solenoid apparatus of the present invention.
FIG. 5 is a plan view of a scroll spring used in solenoid apparatus of the invention.
Figure 4:
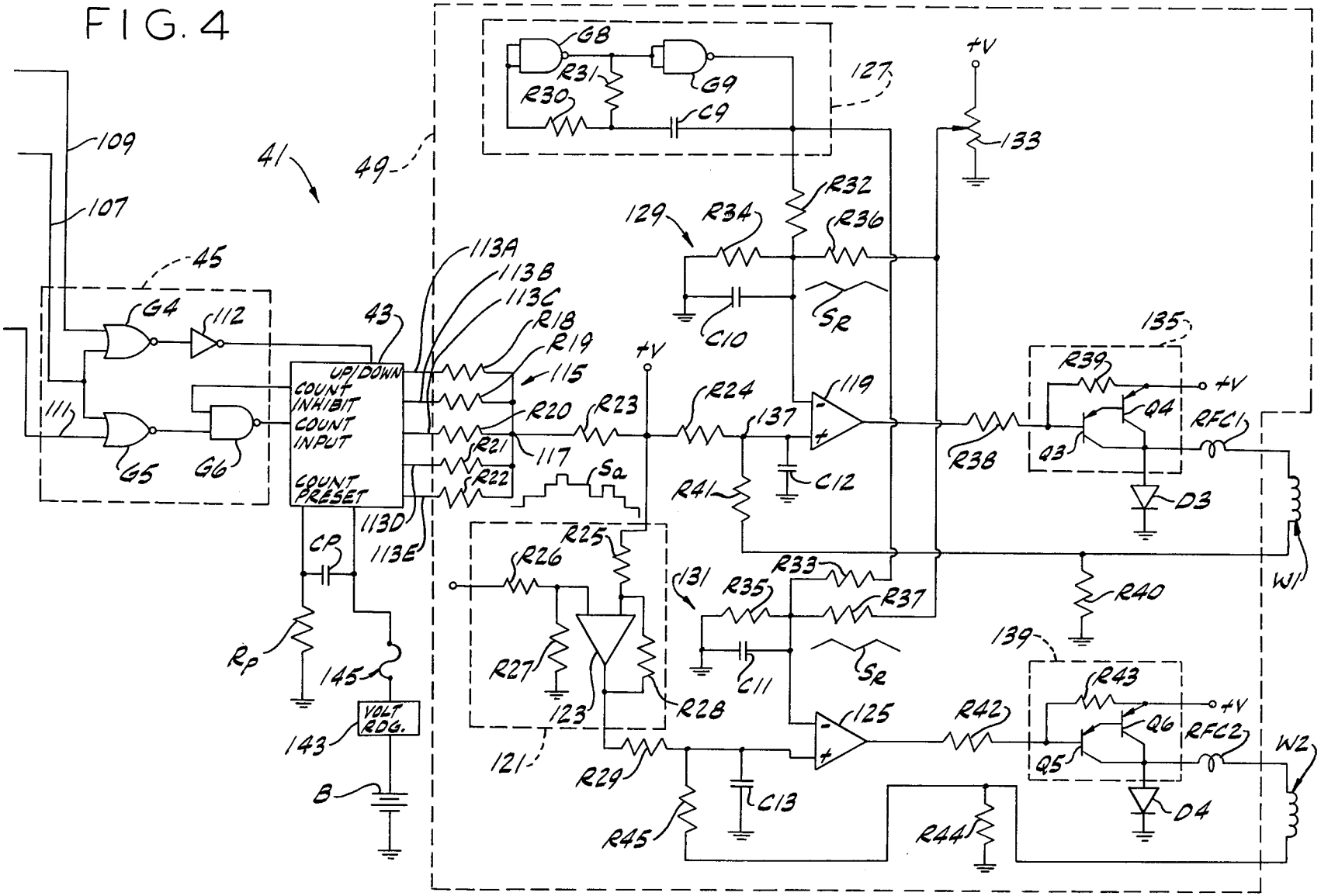
FIG. 4 is a schematic circuit diagram of controller circuitry for use with solenoid apparatus of the present invention.

Referring now to FIGS. 2 and 4, air metering unit 17 is shown (FIG. 2) together with the controller 41 circuitry (FIG. 4) used with the unit. As shown in FIG. 2, carburetor 3 contains two fuel supply systems, a high-speed (main) system 9A and a low-speed (idle) system 9B. In high-speed system 9A, fuel flows from a bowl B through a metering jet 59 and the flow rate of fuel is controlled by a tapered metering rod 61 positioned in the jet by throttle TV. Fuel metered through jet 59 enters a well 63 from which it is drawn into passageway 5 through a nozzle 65. In low-speed system 9B, fuel leaving jet 59 enters the system through a low-speed jet 67. The fuel is then mixed with air entering the system at an air bleed 69 and the mixture is accelerated through a restriction 71 and mixed with more bleed air entering the system through an air bleed 73. The resultant mixture is discharged into passageway 5 through idle ports 75 which are located downstream from closed throttle TV.

For a carburetor 3 as shown in FIG. 2, air metering unit 17 has two air outlets, 21A and 21B respectively, one for each fuel system and a metering pin 29A and 29B is disposed in the respective outlets. Outlet 21A communicates with a conduit 11A by which air is introduced into fuel system 9A and outlet 21B communicates with a conduit 11B by which air is introduced into fuel system 9B. Air flowing through conduit 11A enters fuel system 9A at a point above the fuel level in well 63. The effect of varying the quantity of air entering system 9A through the conduit is to modulate, in effect, the vacuum pressure on the fuel and thus vary the quantity of fuel delivered through nozzle 65. Air flowing through conduit 11B enters fuel system 9B between restriction 71 and idle ports 75. Varying the quantity of air entering system 9B through conduit 11B modulates the vacuum pressure at low-speed jet 67 and this controls the quantity of fuel mixed with bleed air. Metering pins 29A and 29B are both tapered and each is insertable into and withdrawable from its respective air outlet. Positioner 31 of metering unit 17 simultaneously positions both metering pins in their respective air outlets in response to the control signal supplied to the positioner from controller 41. It will be understood that while the same quantity of air may be introduced into fuel systems 9A and 9B through conduits 11A and 11B, the flow rate of air through the respective conduits is dependent upon which carburetor circuit is in use at any one time.

The positioner 31 shown in FIG. 2 includes a variable position solenoid 77 of the present invention. The solenoid magnet has two windings, W1 and W2 respectively, to which current is supplied. Current flow through each of the windings induces respective magnetic fields in each winding the strengths of which are functions of the average current flow through each winding. The magnetic fields combine to produce a net magnetic field. The solenoid further has an armature 79 movable in either of two directions between a first position P1 representative of a first value of the contents of control counter 43 and a second position P2 representative of a second value of the control counter contents. Movement of the armature from position P1 to P2 is through a predetermined number of discrete intermediate positions, as will be discussed. Position P1 corresponds to the dashed line position shown in FIG. 2 in which the upper end of armature 79 contacts a stop 81 formed on the inner surface of a pole piece 83, while position P2 corresponds to the dashed line position in FIG. 2 in which the lower end of armature 79 contacts a stop 85 formed on the inner surface of a pole piece 87. Armature 79 has a longitudinal central bore 89 in which is inserted a shaft 91 threaded at each end. A plate 93 has a central threaded bore 95 and is mounted on one end 97 of shaft 91. Thus, plate 93 is movable with armature 79 as the armature moves between first and second positions P1 and P2. A pair of sockets 99 are formed in the upper face of plate 93 and each metering pin has a stem 101 whose free end fits into one of these sockets. A spring 103 is positioned between each metering pin and a wall 105 of metering unit 17 to bias the pins toward a position to close the outlet in which each is disposed. Outwardly of each pole piece 83 and 87 is a scroll spring 107 having a central bore 109 in which shaft 91 is disposed. The scroll springs are made of a thin, resilient disk-shaped material which is flexible in either direction depending upon the position of armature 79 and shaft 91. As shown in FIG. 5, each spring has a portion cut away during its manufacture and the cuts or slots 110 are made in a predetermined pattern so as armature 79 and shaft 91 move in one direction or the other between positions P1 and P2, when a change in the control signal supplied to windings W1 and W2 occurs, the movement is linear and each movement is for an incremental distance between the two positions. Each scroll spring acts on a respective end of armature 79 (through shaft 91) to bias the armature toward one of the intermediate positions which constitutes a reference position as indicated by the dashed line $P_R$. The springs bias the armature in downward direction away from position P1 and in an upward direction away from position P2. The position of the armature at any one time is determined by the net magnetic field and a force on the armature produced by the scroll springs. When the armature is at its reference position, which is, for example, a position midway between positions P1 and P2, the force exerted by the springs balances the force created by the net magnetic field.

Referring to FIG. 4, counter control 45 of controller 41 includes a pair of NOR gates G4 and G5 and a NAND gate G6. The delay signal supplied by delay counter 53 is provided to one input of gates G4 and G5 on a line 107. The first and second signal elements of second electrical signal S2 are supplied to a second input of gate G4 on a line 109, while elements of timing signal St are supplied on a line 111 to a second input of gate G5 through a NOR gate G7 (see FIG. 3) which acts as an inverter. The output of gate G5 is connected to one input of gate G6 and the output of gate G6 is connected to the count input of counter 43. Control counter 43 is a five-stage binary counter whose contents may vary between a value of 0 and 31 and armature 79 is thus movable to any of 32 discrete positions depending upon the value of the control counter contents. The position P1 which armature 79 of variable position solenoid 77 may attain corresponds to the zero value while the position P2 corresponds to the value 31. The logic output from gate G4 is supplied to an up/down input of the counter through an inverter 112 and the logic level supplied to this input determines whether the counter contents are incremented or decremented, the contents being incremented when a logic high is supplied to the input and decremented when a logic low is supplied to the input. Counter 43 has an inhibit output which is connected to a second input of gate G6 for reasons to be discussed.

As previously indicated, a first signal element of delay signal Sd is supplied by delay counter 53 to counter control 45 so long as the value of its contents is less than two. When this signal element (a logic high) is supplied to gate G5, the logic output of the gate is held low and passage of timing signal elements to counter 43 is inhibited. When a second signal element of the delay signal (a logic low) is supplied to gate G5, elements of the timing signal are passed to gate G6. If the velue of the contents of control counter 43 is less than 31, when the counter is being incremented, or more than zero when the counter is being decremented, the input signal to gate G6 from the inhibit output of counter 43 is a logic high and timing signal elements are passed to the count input of the counter. As the contents of counter 43 change, the digital signal output of the counter changes. This signal is supplied on lines 113A through 113E to interface circuitry 49 and more specifically, to a digital-to-analog converter 115. The digital-to-analog converter is comprised of resistors R18, R19, R20, R21 and R22 and produces an analog signal Sa at a summing point 117. The amplitude of the analog signal is a function of the value of the contents of counter 43 and is increased a predetermined amount each time the contents of counter 43 are incremented, decreased by the same predetermined amount each time the counter contents are decremented and remains the same so long as sampler 51 inhibits the supply of timing signal elements to counter control 45.

The analog signal produced at summing point 117 is supplied through a current limiting resistor R23 and a resistor R24 to one input of a comparator 119, the non-inverting inut of an operational amplifier. The analog signal is further supplied to a unity gain inverting amplifier 121 which includes an operational amplifier 123, an input resistor R24, a pair of resistors R26 and R27 which form a voltage divider and a feedback resistor R28. The inverted analog signal supplied at the output of amplifier 121 is applied through a resistor R29 to one input of a comparator 125, also the non-inverting input of an operational amplifier.

Comparators 119 and 125 compare the amplitude of the analog signal supplied thereto with the amplitude of a reference signal S*r* to produce first and second signal elements of the control signal which are supplied to windings W1 and W2 of solenoid 77. A fixed-frequency square-wave generator 127 produces a square-wave signal. The generator is comprised of a pair of NAND gates G8 and G9, a pair of resistors R30 and R31 and a capacitor C9 and operates, as is well known in the art, to produce a square wave at a frequency which is, for example, 1KHz. The square-wave output of generator 127 is supplied through a resistor R32 and a resistor R33 to a pair of integrating circuits generally indicated 129 and 131 respectively. Integrating circuit 129 consists of a resistor R34 and a capacitor C10 while integrating circuit 131 consists of a resistor R35 and a capacitor C11. The output of each circuit is reference signal S*r*, which has a triangular waveform, and this signal is supplied to the inverting input of comparators 119 and 125. Further, the reference signal supplied to each comparator is superimposed on a bias voltage level produced by a potentiometer 133 and applied to the respective reference signal input paths via a resistor R36 and a resistor R37. The setting of potentiometer 133 is such that the bias voltage level on which the reference signal is superimposed is approximately one-half the voltage corresponding to the difference between a logic high and a logic low.

Elements of the control signal supplied at the output of comparator 119 are supplied to a driver circuit 135 through a resistor R38. Driver circuit 135 includes a pair of PNP transistors Q3 and Q4 and a bias resistor R39 and the output of the driver circuit is connected to winding W1 of solenoid 77 through a radio-frequency choke RFC1. A pair of resistors R40 and R41 and a capacitor C12 form a negative feedback circuit by which the amount of current flowing in winding W1 is sensed and a signal indicative thereof provided to a summing point 137. Elements of the control signal from comparator 125 are supplied to a driver circuit 139 through a resistor R42. Driver circuit 139 comprises a pair of PNP transistors Q5 and Q6 and a bias resistor R43. The output of the driver circuit is connected to winding W2 through a radio-frequency choke RFC 2 and a pair of resistors R44 and R45 and a capacitor C13 form a negative feedback circuit by which the current flowing in winding W2 is sensed and a signal indicative thereof supplied to a summing point 141. Each driver circuit has a diode, D3 and D4 respectively, connected between its output and electrical ground. These diodes shunt voltage spikes induced in windings W1 or W2 when a second signal element of the control signal, a low voltage level, is supplied to a winding and a magnetic field previously induced in the winding collapses.

Operation of the apparatus is as follows:

Assume that the amount of oxygen in exhaust system 15 is increasing, indicating that the air-fuel ratio of the mixture is increasing or that the mixture is getting leaner. For this condition, the amplitude of first electrical signal S1 is decreasing and this amplitude is compared with reference level Vref by comparator 39. If the amplitude of signal S1 is initially greater than the reference level amplitude, it eventually falls below that level as the mixture keeps getting leaner. When the reference level amplitude is passed, a transition T in second electrical signal S2 occurs and the comparator 39 output goes from low to high and a first rather than a second signal element of second electrical signal S2 is produced. This logic high is supplied on line 109 to gate G4 of counter control 45 and to delay counter reset circuitry 55.

The logic high from comparator 39 is inverted to a low by gate G1 and is also supplied through a current limiting resistor R46 and a R-C network comprised of a resistor R47 and a capacitor C14 to one input of gate G3. The other input to gate G3 is the inverted output of comparator 39 which is supplied to the gate through a resistor R48 and a R-C network including a resistor R49 and a capacitor C15. A logic high to either input of gate G3 momentarily forces the gate output low and, as previously discussed, the logic output from gate G3 is supplied to the inverting input of comparator 58. By forcing the logic output of gate G3 momentarily low, comparator 58 is forced to supply a logic high at its output regardless of the level to which capacitor C6 is charged, and this prevents capacitor C6 from discharging since transistor Q2 is kept in its non-conducting state. Thus, the generation of timing signal elements is momentarily inhibited. After a predetermined period established by the time-constant of the R-C networks, the logic output of gate G3 goes high and timing signal elements are again generated. Gate G3 therefore synchronizes the supply of timing signal elements to sampling network 51 and controller 41 with the random occurrence of transitions between signal elements of the second electrical signal.

Delay counter 53 is reset via reset circuitry 55 upon occurrence of the transition, as previously discussed, and a first signal element (a logic high) of delay signal Sd is supplied on line 107 to gates G4 and G5. This high inhibits gate G5 from passing timing signal elements supplied to it on line 111. If the amplitude of signal S1 does not rise above that of reference level Vref prior to two consecutive timing signal elements being supplied to delay counter 53 after it is reset, the counter output changes from a first to a second signal element of the delay signal. Gate G4 now has a logic high and a logic low applied to its inputs and a logic high is supplied to the up/down input of control counter 53 from inverter 112 signifying that the contents of the counter are to be incremented. Gate G5 is now supplied a logic low on line 107 and passes each timing signal element supplied to it. If the value of the contents of counter 43 is less than 31, the input to gate G6 from the count inhibit output of the counter is high and gate G6 passes the timing signal elements to the count input of the counter.

Each timing signal element received by counter 43 at its count inputs results in the contents of the counter being increased by one. If a logic low were being supplied to the up/down input of the counter, its contents would be decreased by one for each timing signal element received. Each time the contents of counter 43 are incremented, the composition of the digital signal supplied to interface 49 changes and each change results in a step increase in the amplitude of analog signal S*a* produced at summing point 117 and supplied to comparators 119 and 125.

The signal applied to the non-inverting input of comparators 119 and 125 is a function of the analog signal amplitude and the current presently flowing in windings W1 and W2 of solenoid 77. This input signal is developed at the respective summing points 137 and 141. The average current flowing in the solenoid windings is determined by the amount of time a first signal element of the control signal is supplied to each winding as compared to a second signal element of the control signal and this, in turn, is a function of the amount of time within each cycle of the reference signal that the analog signal amplitude exceeds the reference signal amplitude. With the contents of counter 43 at one value, the analog signal amplitude is a level which exceeds the reference signal amplitude for a certain portion of each reference signal cycle. This results in driver circuits 135 and 139 each being on for a portion of each cycle and a current flows through each winding and induces a magnetic field whose force holds armature 79 at a position between positions P1 and P2. As previously discussed, the position of metering pins 29A and 29B in their respective outlets is determined by the armature position as is the quantity of air admitted into conduits 11A and 11B.

With an increase in the analog signal amplitude, there is an increase in the voltage level at the non-inverting input to comparator 119 and a decrease in the voltage level at the non-inverting input to comparator 125. This latter is because of the signal inversion by amplifier 121. The potentiometer 133 setting and the values of resistors R36 and R37 are such that when the value of the contents of counter 43 are at their mid-range value, the input level to both comparators is equal. For this condition each comparator supplies a control signal to respective windings W1 and W2 in which the length of time a first element is supplied to the winding during a reference signal cycle is equal to the length of time a second signal element is supplied to the winding.

With the increase at the non-inverting input to comparator 119, the input amplitude momentarily exceeds the reference signal amplitude throughout the reference signal cycle and a first element of the control signal is continuously supplied to winding W1. This results in an increase in the average current flowing through the winding and this increase is reflected at junction 137 through the comparator 119 feedback circuit. An increase in the average current flow results in a decrease in the voltage level input to the comparator so that the analog signal amplitude begins to fall and again exceeds the reference signal amplitude for only a portion of each reference signal cycle. Finally, a steady state condition is reached in which a first signal element of the control signal is supplied to winding W1 for a greater portion of each reference signal cycle than before the increase in the analog signal amplitude. This portion continues to increase as long as the contents of control counter 43 are incremented.

The opposite occurs at comparator 125 in which the increase in analog signal amplitude results in the reference signal amplitude exceeding the analog signal amplitude throughout a reference signal cycle. As a consequence, no current is supplied to winding W2 and the average winding current decreases. This is reflected at junction point 141 as an increase in the voltage level input to comparator 125 and the analog signal amplitude again exceeding the reference signal amplitude for part of each cycle. Finally, a steady state condition is reached in which first and second signal elements of the control signal are supplied to winding W2 in a new ratio with the second signal element being supplied for a longer portion of each reference signal cycle than was the case prior to the analog signal amplitude increase. Thus, the amount of time current is supplied to winding W1 during a predetermined time period (the period being determined by generator 127) differs from the amount of time current is supplied to winding W2 and the average current flow in each winding differs as do the strengths of the magnetic fields produced by each winding. The net result of these changes is the movement of armature 77 one step closer to position P2 and insertion of the metering pins into their respective outlets and enrichment of the air-fuel mixture.

It will be understood that if the contents of counter 43 are decremented, the reverse of the situation above described would occur. That is, a step decrease in the analog signal amplitude results in signal elements of the control signal being supplied to winding W1 with the portion of time a first signal element is supplied to the winding compared to a second signal element being less that before the decrease, while for the control signal supplied to winding W2 the portion increases. Armature 79 thus moves one step closer to position P1 and the metering pins are withdrawn from their outlets and the air-fuel mixture is leaned.

The supply of timing signal elements to controller 41 and the resultant change in position of armature 79 and metering pins 29A and 29B continues until the amplitude of first electrical signal S1 crosses reference Ref. This, as described, produces a transition between signal elements of second electrical signal S2 and delay counter reset circuitry 55 responds to the transition to reset delay counter 53 and terminate the supply of a second signal element of the delay signal to counter control 45 and supplies a first signal element instead. This inhibits counter control 45 from supplying any further timing signal elements to control counter 43.

It is important for proper operation of the apparatus that the value of the contents of counter 43 not exceed a maximum value when the counter is being incremented or a minimum value when the counter is being decremented. If, for example, the value of the counter contents is thirty-one and the counter is being incremented, the next timing signal element supplied to the counter results in the capacity of the counter being exceeded and the digital signal on lines 113A to 113E representing a zero. Were the capacity to be exceeded, armature 79, which is at position P2 for a count value of thirty-one would be driven to position P1. More air would be introduced into conduits 11A and 11B and the air-fuel mixture would be leaned. This, however, is the condition trying to be remedied and as a result is only made worse. The reverse is true when the counter is being decremented and the value of its contents reaches zero. To prevent this from happening, counter 43 supplies a logic low to gate G6 whenever one of the two conditions occurs and this inhibits gate G6 from passing timing signal elements to the count input of the counter. This logic low remains until the direction of counting of the counter's contents changes or until an adjustment in the carburetion is made and the value of the counter contents is set to a preset value.

The contents of counter 43 are forced to a preset value whenever power is first applied to the counter. This occurs, for example, when power is first supplied to the apparatus after its installation or when power is first applied to the apparatus after power disruption. An R-C circuit comprised of a capacitor $C_p$ and a resistor $R_p$ produces a momentary logic high at the preset input of the counter and this sets the value of the counter contents to a mid-range value. Setting the contents of counter 43 to the preset value results in the air-fuel ratio being adjusted to a mid-range value. Additionally, voltage from a power source, for example, an automobile battery B, is continuously supplied to the counter when the engine is shut down to maintain the value of the counter contents at the last value attained prior to engine shutdown. This is accomplished, for example, by regulating the battery voltage by a regulator 143 and supplying the regulated voltage output to counter 43 through a clock-fuse circuit generally indicated at 145 which is closed even when engine E is shut down. By maintaining the value of the counter contents at their last attained value, the air-fuel ratio of the mixture has approximately the same value it previously had when the engine is restarted. This helps improve pollution control when the engine is restarted especially when an automobile in which engine E is placed is driven from one part of the country to another where altitude and other atmospheric conditions have a different effect on the air-fuel ratio than the conditions at the previous location.

Timing unit 47 generates timing signal elements at a first repetition rate when engine E is operating under steady state conditions and at a second and faster repetition rate when a non-steady state condition is created such as when the engine accelerates or decelerates. The operation of timing unit 47 to generate timing signal elements at the first repetition rate which is, for example, 1.5 Hz, has been previously described, and involves charging timing capacitor C6 and comparing the charge level of the capacitor with a reference voltage level by comparator 58 and discharging the capacitor when the reference level is reached. When steady state operation of the engine changes, it is reflected, for example, by a change in engine manifold pressure. A switch 165 is positioned in the manifold and is responsive to pressure changes which occur when a non-steady state condition is created to close and remain closed until a new steady state condition is reached.

When a steady state condition exists, a capacitor C18 is charged through a resistor R56. As timing capacitor C6 charges, current flows through a pair of resistors R57 and R58, which form a divider network, and resistor Rc to ground. Current flow through this path has the effect of reducing the charge rate of capacitor C6 by decreasing the capacitor charge current. When a non-steady state condition is created, a resistor R59 is connected to ground through closed switch 165. The flow of current through the divider network is reversed and this effectively increases the charge current of capacitor C6, so that the capacitor charges at the second and faster rate, which rate is, for example, approximately three times the first rate. This second charge rate continues until switch 165 opens at which time the rate exponentially decays back to the first rate. The decay rate is determined by the values of resistor R56 and capacitor C18. Because discharge of capacitor C6 is controlled by comparator 58, as described, the pulse width of the timing signal elements produced at junction 57 is maintained substantially constant regardless of the charge rate of capacitor C6 or the repetition rate at which the timing signal elements are produced.

The rate at which timing signal elements are generated may also be a function of the state of detector 35 or which signal element of second electrical signal S2 is supplied by comparator 39. Thus, for example, a resistor R60 and a potentiometer 167 may be optionally connected between the input to gate G1 and the non-inverting input of comparator 58. Thus, when the air-fuel mixture is lean, as sensed by detector 35, and a first signal element of the second electrical signal is supplied at the output of comparator 39, current flows through resistor R60 and potentiometer 167 from the comparator and lowers the capacitor C6 charging current and the rate at which timing signal elements are produced. When detector 35 senses a rich mixture and a second signal element of the second electrical signal is supplied at the output of comparator 39, the current flow through resistor R60 and the potentiometer is reversed and the rate at which capacitor C6 is charged increases. Consequently, a bias toward a leaner air-fuel mixture is created since the response of the apparatus is slower when a lean mixture is sensed. By connecting a resistor R60A between the output of inverter gate G1 and potentiometer 167 instead of connecting resistor R60 at the gate input, the opposite result is produced with the bias now toward a richer mixture.

When engine E is not started for some period of time after it is shut down, a cold start condition exists in which the operating temperature of detector 35 is initially less than some preselected value, for example 400° C (752° F). In such a situation, it is desirable not to change the control signal supplied to air metering unit 17 until the detector temperature rises above the preselected value. Since detector 35 has a temperature-dependent internal impedance, circuitry for preventing a change in the control signal comprises a bridge network 169 with the detector impedance included in one leg of the bridge and with another leg of the bridge including an impedance whose value is a function of the detector impedance at the preselected value. One-half of bridge 169 includes the impedance of detector 35, resistor R1 and capacitor C1 and a resistor R61 and a pair of capacitors C19 and C20 respectively. The other half of the bridge comprises a pair of resistors R62 and R63 and the bridge is substantially balanced when the detector temperature is at the preselected value. The bridge output is connected to a comparator 171 (an operational amplifier) which includes a pull-up resistor R64. Comparator 171 supplies first and second signal elements of a bridge output signal to one input of gate G2. A first signal element of the bridge output signal (a logic high) is supplied by comparator 171 when the detector temperature is above the preselected value and a second signal element (a logic low) is supplied when the detector temperature is below the preselected value. When a timing signal element is generated, a pulse is produced by bridge 169 and provided to the non-inverting input of comparator 171. This pulse is a negative going pulse whose amplitude is determined by the internal impedance of detector 35 and compared with the reference voltage at the inverting input to the comparator.

The other input to gate G2 is supplied with elements of an enabling signal. An enabling signal element is produced ach time a timing signal element is generated. The circuitry for producing an enabling signal element includes a pair of resistors R65 and R66 respectively, a diode D9 and a capacitor C21. One side of capacitor C21 is connected to the output of inverter G7 which, as previously noted, inverts the timing signal produced at junction 57. Thus, the logic output of gate G7 is normally low but goes high during the period an element of the timing signal is produced. As a consequence, an element of the enabling signal is produced at the trailing edge of a timing signal element and is a momentary high-to-low transition at the input to gate G2.

If a first signal element of the bridge output signal is present at the input to gate G2 when an enabling signal element is supplied to the gate, the logic output of the gate is low. As previously described, the output of gate G2 is connected to delay counter 53 and specifically to the set input of flip-flop FF1 and the reset input of flip-flop FF2. A logic low supplied by gate G2 to counter 53 has no effect on the counter. If, however, a second signal element of the bridge output signal is supplied to gate G2 when an enabling signal element is supplied, it indicates that the temperature of detector 53 is below the threshold level and a logic high is supplied by the gate to counter 53 and the counter is reset. Thus, until the detector temperature exceeds the predetermined value, counter 53 is reset each time a timing signal element, which normally increments counter 53, is generated. Therefore, the contents of counter 53 cannot reach the value of two which is necessary in order for controller 41 to accept timing signal elements and produce a change in the control signal supplied to air metering unit 17.

Besides not wanting to change the control signal supplied to air metering unit 17 during a cold start, it is also desirable to hold off or prevent a change in the control signal at other times, as for example, during heavy accelerations (wide-open throttle). For this purpose, a hold off switch 173 is closed whenever a particular engine operating condition is created during which no change in the control signal is to be produced. When switch 173 is closed, the non-inverting input of comparator 171 is effectively grounded through a circuit which includes resistors R67, R68 and R69 and a capacitor C22. With the non-inverting input of the comparator grounded, a second signal element of the bridge output signal is supplied to gate G2 and results in the gate supplying a logic high to delay counter 53 whenever an enabling signal element is supplied to the gate. Counter 53 is reset by the logic high from gate G2 and continues to be so until switch 173 opens.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. Solenoid Apparatus for metering the quantity of air supplied to a fuel system in a carburetor for an internal combustion engine, said carburetor having at least one air passageway therein through which air is drawn into eingine, fuel from a source thereof being supplied to said carburetor through said fuel system and mixed with air as it passes through the carburetor and the carburetor having a conduit through which air is introduced into said fuel system, the apparatus comprising:

a chamber having an air inlet in communication with the air passageway of the carburetor and an air outlet in communication with the conduit;

first and second electrical windings to which current is supplied, current flow through each of said windings inducing respective magnetic fields the strengths of which are functions of the average current flow therethrough and the magnetic fields combining to produce a net magnetic field;

an armature movable in either of two directions between a first position and a second position;

means biasing the armature toward a position intermediate the first and second positions constituting a reference position, the position of the armature at any one time being determined by the net magnetic field and a force on the armature produced by the biasing means, said biasing means comprising first and second springs acting on respective ends of the armature to bias the armature in one direction away from said first position and in the opposite direction away from said second position, the forces exerted by said springs being balanced by the net magnetic field when the armature is at said reference position, and said armature having a shaft extending axially through the springs and movable therewith, each spring being a scroll spring comprised of a disk of resilient material having a central opening therethrough in which an end of said shaft is disposed and a plurality of slots cut in a predetermined pattern such that each spring is flexible in either direction of armature movement for linear movement of the armature from one position to another;

metering means disposed in said air outlet and movable with the armature as it moves between said first and second positions to more fully open or close the air outlet depending upon the direction of armature movement;

means for supplying current to said windings; and control means to which the current supply means is responsive for varying the average current flow in each winding, each variation in the average current flow produced by the control means resulting in movement of the armature and changing of the position of the metering means relative to the air outlet thereby to change the quantity of air supplied to the fuel system through the conduit.

2. Apparatus as set forth in claim 1 wherein the carburetor has a second fuel system and a second conduit through which air is introduced into said second fuel system and the chamber further includes a second air outlet in communication with said second conduit and a second metering means is disposed in said second air outlet and movable with the armature as it moves between said first and second positions to more fully open or close the second air outlet depending upon the direction of armature movement.

* * * * *